US007371178B2

(12) United States Patent
Yano et al.

(10) Patent No.: US 7,371,178 B2
(45) Date of Patent: May 13, 2008

(54) CARD GAME SYSTEM

(75) Inventors: Keiji Yano, Tokyo (JP); Tomio Kikuchi, Tokyo (JP)

(73) Assignee: Sega Corporation (JP)

( * ) Notice: Subject to any disclaimer, the term of this patent is extended or adjusted under 35 U.S.C. 154(b) by 496 days.

(21) Appl. No.: 10/178,242

(22) Filed: Jun. 25, 2002

(65) Prior Publication Data

US 2003/0022708 A1 Jan. 30, 2003

(30) Foreign Application Priority Data

Jun. 29, 2001 (JP) ..... 2001-198602

(51) Int. Cl.
*A63F 1/00* (2006.01)
*A63F 13/00* (2006.01)
*G06F 17/00* (2006.01)

(52) U.S. Cl. ..... 463/43; 463/1; 463/11; 273/292; 273/293; 273/308; 235/375

(58) Field of Classification Search ..... 463/1, 463/44, 43, 11–25, 40–42, 47; 273/292, 273/308, 459, 149 R, 236–237, 296; 434/1, 434/11, 219; 235/375, 487
See application file for complete search history.

(56) References Cited

U.S. PATENT DOCUMENTS 4,861,031 A * 8/1989 Simms ..... 273/295
5,149,093 A * 9/1992 Schilling et al. ..... 273/118 A
5,212,368 A * 5/1993 Hara ..... 235/375
5,662,332 A * 9/1997 Garfield ..... 273/308
5,743,801 A * 4/1998 Welander ..... 463/44
5,938,726 A * 8/1999 Reber et al. ..... 709/217
5,941,769 A * 8/1999 Order ..... 463/12
5,971,397 A * 10/1999 Miguel et al. ..... 273/371
5,989,122 A * 11/1999 Roblejo ..... 463/22
6,061,656 A * 5/2000 Pace ..... 705/1
6,200,216 B1 * 3/2001 Peppel ..... 463/1
6,322,077 B1 * 11/2001 Braunlich et al. ..... 273/292
6,412,779 B1 * 7/2002 Kenney ..... 273/292
6,419,584 B1 * 7/2002 Sakamoto et al. ..... 463/43
6,435,508 B1 * 8/2002 Tavel ..... 273/292
6,468,162 B1 * 10/2002 Nakamura ..... 463/43
6,547,662 B2 * 4/2003 Yamada ..... 463/11
6,601,851 B1 * 8/2003 Sakamoto et al. ..... 273/308
6,626,434 B2 * 9/2003 Tanaka ..... 273/292
6,663,105 B1 * 12/2003 Sullivan et al. ..... 273/138.2
6,666,770 B1 * 12/2003 Kubo et al. ..... 463/43
6,735,324 B1 * 5/2004 McKinley et al. ..... 382/100
7,118,482 B2 * 10/2006 Ishihara et al. ..... 463/43
2002/0028710 A1 * 3/2002 Ishihara et al. ..... 463/44

* cited by examiner

*Primary Examiner*—Xuan M. Thai
*Assistant Examiner*—Meagan Thomasson
(74) *Attorney, Agent, or Firm*—Dickstein Shapiro LLP

(57) ABSTRACT

A card game system is disclosed, which enables to execute the card game using a basic function of a video game apparatus. The card game system includes a card acceptance means for accepting a plurality of cards of either a first category or a second category each having information attached thereto for identifying each, a memory for storing card data and a program for controlling a card game, and a controlling means for defining the first category cards as the cards for use in a card game based on the card data, and for controlling to execute the card game according to the program stored in the memory, wherein the control means controls to execute the card game depending on the number of second category cards detected by the card acceptance means.

13 Claims, 7 Drawing Sheets

CARD GAME SYSTEM

FIELD OF THE INVENTION

The present invention relates to a card game system for controlling to execute a card game using cards and an execution control method therefor.

DESCRIPTION OF THE PRIOR ART

Video game apparatus have been installed heretofore in a game center, etc. By injecting coins or a medal corresponding to a playing charge, a player enjoys playing a game operating a character of his own to match against another character controlled by a computer.

Meanwhile, in recent years it has become widespread to play a card game using special cards. As such cards for use in the card game, there exist a plurality of cards to be categorized into a plurality of types. A character is represented on each card together with description on character property in the card game concerned. Moreover, attacking power level as well as defending power level provided in each card is indicated.

A plurality of new cards for such card games are being issued by card game manufacturers continually at proper intervals. Accordingly a player purchases and collects the cards he desires to meet his game strategy plan in a certain card game.

When playing a card game, one player, or a plurality of players, constructs a bunch (which is referred to as deck) consisting of a predetermined number of cards. Using this, each player alternatively places a card on the table from the deck. Depending on the effect included in each card character and the levels of attacking power and defending power, a predetermined score is incremented or decremented. Victory or defeat is settled when the score reaches a predetermined condition.

Here, the system is constituted in such a manner that any player cannot select a particular card to purchase even when the player intends to collect a desired card to construct a deck advantageous to the player.

Namely, it is required for the player to purchase a plurality of cards in batch. Therefore, in the purchased card batch, there may possibly be included a card which has already been owned by the player, or a card which is not suitable for the player's intended strategy. For the sake of convenience, such a card is referred to as a useless card hereinafter. These useless cards are apt to be accumulated on the player's hand without being used in playing the card game.

Accordingly, such a situation may generally damage a card value, weaken the player's will to purchase new cards and finally make it possible to loose the player's interest in card games. Further, a card game is normally played between players, which necessitates a player to look for an opponent player. The aforementioned situation makes any player difficult to enjoy a card game whenever the player wants to play.

Moreover, it is desired to introduce a method for utilizing the aforementioned useless cards in a card game and to implement a system by which a single player can enjoy a card game.

SUMMARY OF THE INVENTION

Considering the above-mentioned points of view, it is an object of the invention to provide a card game system enabling to execute the card game using a basic function of the aforementioned video game apparatus.

It is another object of the invention to provide a card game system enabling to utilize useless cards for a card game effectively and to provide an execution control method of a card game.

As a first embodiment of the present invention to attain the aforementioned objects, a card game system includes; a card acceptance means for accepting a plurality of cards as either a first category or a second category, each having information attached thereto for identifying each; a memory for storing card data and a program for controlling a card game; and a controlling means for defining the first category cards as the cards for use in a card game based on the card data, and for controlling to execute the card game according to the program stored in the memory. The control means controls to execute the card game depending on the number of second category cards detected by the card acceptance means.

As a second embodiment of the present invention, a card game system includes; a deck acceptance means for accepting a deck constructed using a plurality of cards each having information attached thereto for identifying each; a memory for storing card data and a program for controlling a card game; and a controlling means for reading out from the memory a plurality of card data constructing a deck for a player and a plurality of card data constructing a deck for a virtual opponent for playing a match against the player's deck to control to execute the card game according to the program stored in the memory.

As a third embodiment of the present invention, in the aforementioned first or second embodiment, the information attached to each plurality of cards for identifying each is a barcode provided on a side end of the card.

As a fourth embodiment of the present invention, in the first embodiment, a player's deck for use in the card game is constructed using the plurality of cards included in the first category.

As a fifth embodiment of the present invention, in the fourth embodiment, the memory stores data included in a plurality of cards and the control means constructs a deck for a virtual opponent to play a match against the player's deck using the data included in the plurality of cards.

As a sixth embodiment of the present invention, in the first embodiment, in case that the first category cards for use in the card game are lacking for a predetermined number necessary for executing the card game, data are supplemented from among a plurality of cards stored in the memory.

As a seventh embodiment of the present invention, in the second embodiment, the control means further supplements data from among a plurality of cards stored in the memory in case that the cards included in the player's deck are lacking for the predetermined number necessary for executing the card game.

As an eighth embodiment of the present invention, in the first embodiment, the card game system further includes a record medium read/write means for accepting a record medium, and on completion of the card game execution control by the control means, card game result information in regard to the corresponding cards of the first category is written into the record medium.

As a ninth embodiment of the present invention, in the sixth embodiment, based on the card game result written in the record medium by the record medium read/write means, the control means updates information being set in cards of the first category for use in the card game when controlling to execute the card game.

As a tenth embodiment of the present invention, in the second embodiment, the card game system further includes a record medium read/write means for accepting a record medium, and on completion of card game execution control by the control means, card game result information in regard to a plurality of cards constructing the player's deck is written into the record medium.

As an eleventh embodiment of the present invention, the card game system of the first embodiment or the second embodiment further includes a mechanism for ejecting new card, coin or medal depending on a card game result.

As a twelfth embodiment of the present invention, in the first or second embodiment, the card data to be stored in the memory is updated based on update data supplied through a network.

As a thirteenth embodiment of the present invention, in the eighth or tenth embodiment, an update data for the card data is stored into the record medium, and on accepting the record medium having the update data stored by the record medium read/write means, the card data is updated by the control means.

Further scopes and features of the present invention will become more apparent by the description of the embodiments described according to the drawings.

PREFERRED EMBODIMENTS OF THE INVENTION

The embodiments of the present invention are described hereafter referring to the accompanied drawings.

Figure 1:
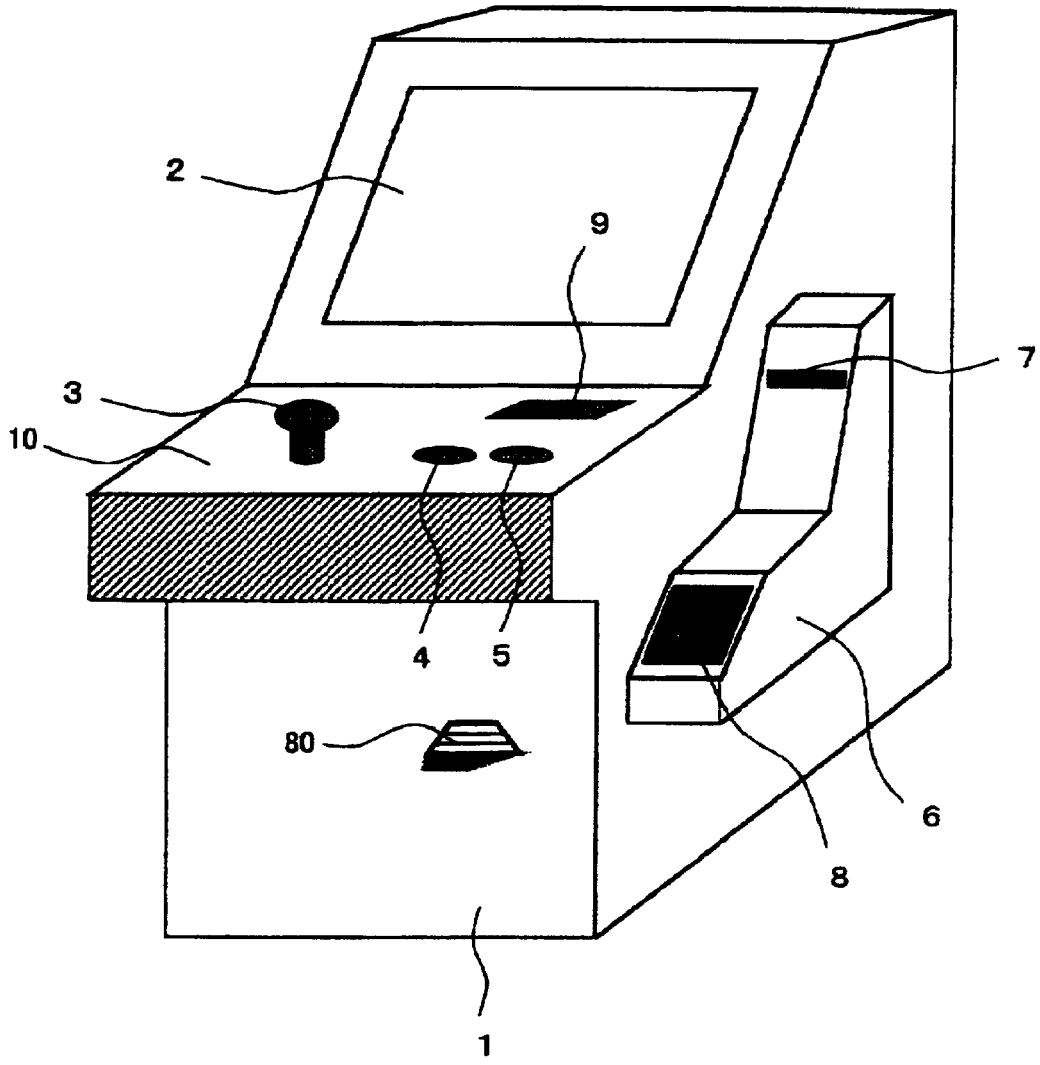
FIG. 1 shows an outer view of the card game apparatus according to one embodiment of the card game system of the present invention.

FIG. 1 shows an outer view of the card game apparatus according to one embodiment of the card game system of the present invention. A main body 1 is provided with a monitor screen 2 and input mechanisms including a unit movement lever 3, an item decision button 4 and a cancel button 5. These input mechanisms are generally the same as those commonly attached to a video game apparatus.

In addition, as a unit particularly provided for the implementation of the present invention, a card insertion unit 6 is attached to main body 1. Card insertion unit 6 includes a deck insertion inlet 8 for inserting a deck in which a plurality of cards is bunched for use in a card game by a player being referred to as a first category of the plurality of cards. Card insertion unit 6 also includes a useless card insertion inlet 7 for inserting useless cards being referred to as a second category of the plurality of cards. Further, a record medium insertion inlet 9 is provided on an operation desk 10 on which the aforementioned input mechanisms are also provided.

Additionally, as an embodiment of the present invention which will be described later, the aforementioned useless card insertion inlet 7 may be used for an injection inlet for a coin or a medal corresponding to the charge required for executing the game, instead of inserting the useless cards.

Further, it is possible to configure the apparatus to dispense either a game card or a medal as a gift depending on the game result. Accordingly, in the embodiment shown in FIG. 1, a dispensation outlet 80 for dispensing such a game card or a medal is provided on main body 1.

Figure 2:
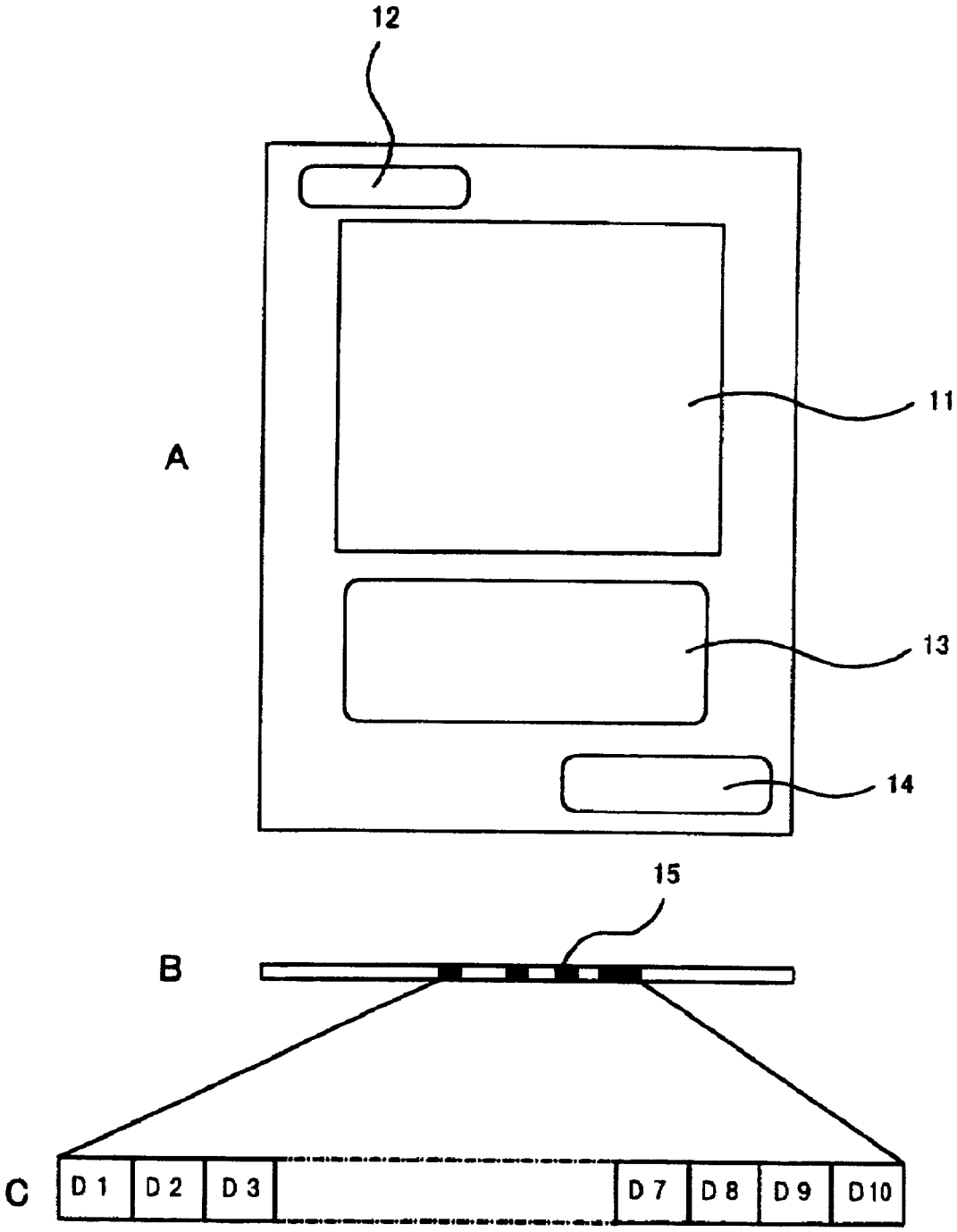
FIG. 2 shows an illustrative card configuration for use in a card game.

Now, an illustrative card configuration for use in the card game is shown in FIG. 2. FIG. 2A is a diagram illustrating an appearance of the card surface. In this card surface, there are provided an area 11 representing a character picture corresponding to a card type, an area 12 representing a card name, an area 13 representing an explanation note including a role, a definition, etc. of the card for use in the game concerned, and an area 14 representing level values of attacking power and defending power of the card concerned.

FIG. 2B shows a diagram illustrating a side face of the card viewed from the top. A barcode 15 is printed on the side face of the card for identifying individual card information for use in the card game system according to the present invention. The method of printing barcode 15 on the card side face has been disclosed on the Japanese patent application No. 2000-365894 by the applicant of the present invention.

Barcode 15 may represent, for example, a 10-bit code as shown by the enlarged illustration in FIG. 2C. The corresponding card information may be retrieved uniquely using this code.

Additionally, in place of barcode 15 formed on the above-mentioned card side face, it is also possible to form the card information identification using other recording method, needless to say. For example, it is possible to record information for identifying the card using a barcode, a picture, letters or the like identifiable by a card reader on a portion of the back or the surface of the card.

Preferably, the above-mentioned information for identifying the card is formed in such a way that a player cannot read the contents easily nor falsify the contents, so as to maintain fairness between players when playing the game.

Figure 3:
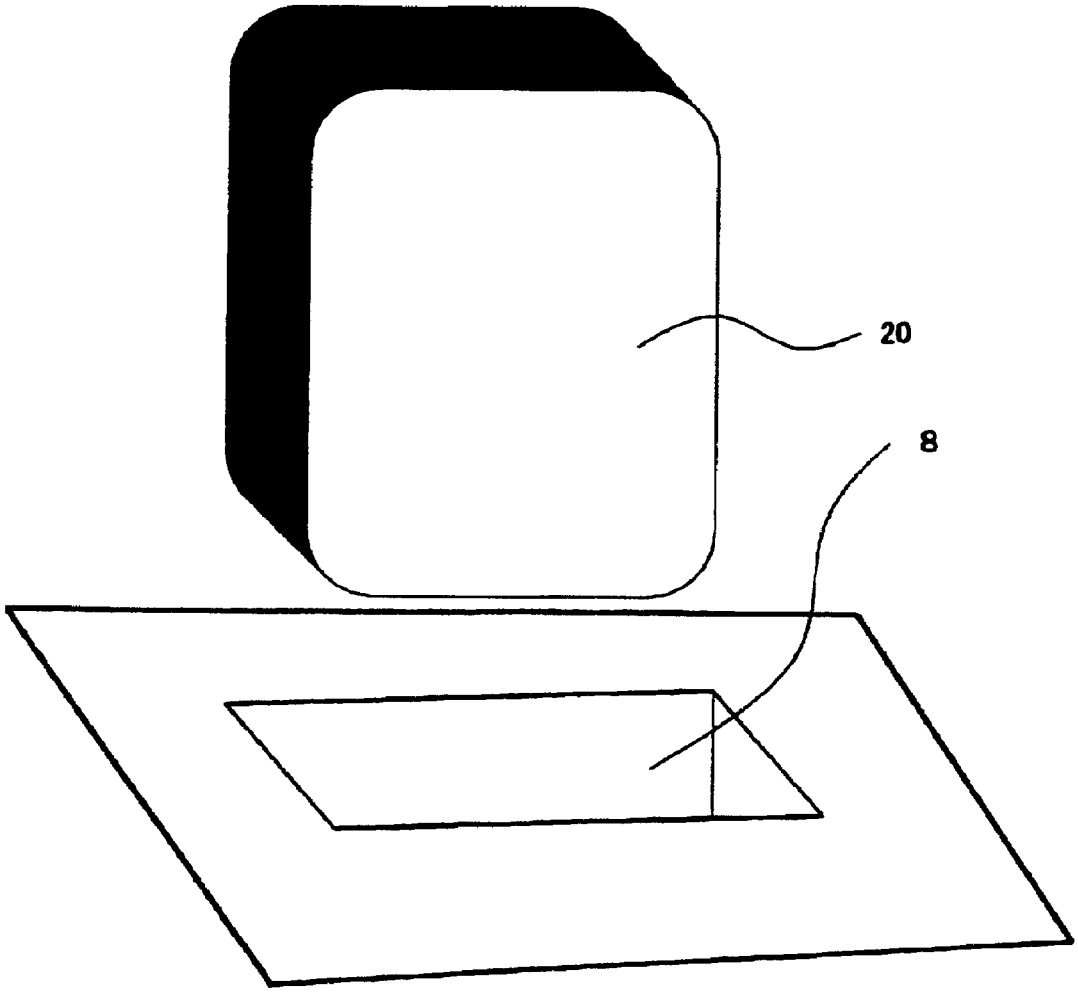
FIG. 3 shows an explanation diagram of a deck constructed using a plurality of cards and an insertion inlet 8 therefor.

FIG. 3 shows an explanation diagram of a deck constructed using a plurality of cards and deck insertion inlet 8. A deck 20 is constructed using bunching cards each having a configuration shown in FIG. 2. Deck 20 is configured with a card bunch of 40 to 60 cards. When playing the game in the card game system of the present invention, a player constructs deck 20 consisting of 40 to 60 cards, then to insert and set into deck insertion inlet 8 of card insertion unit 6 provided in the card game apparatus shown in FIG. 1.

Figure 4:
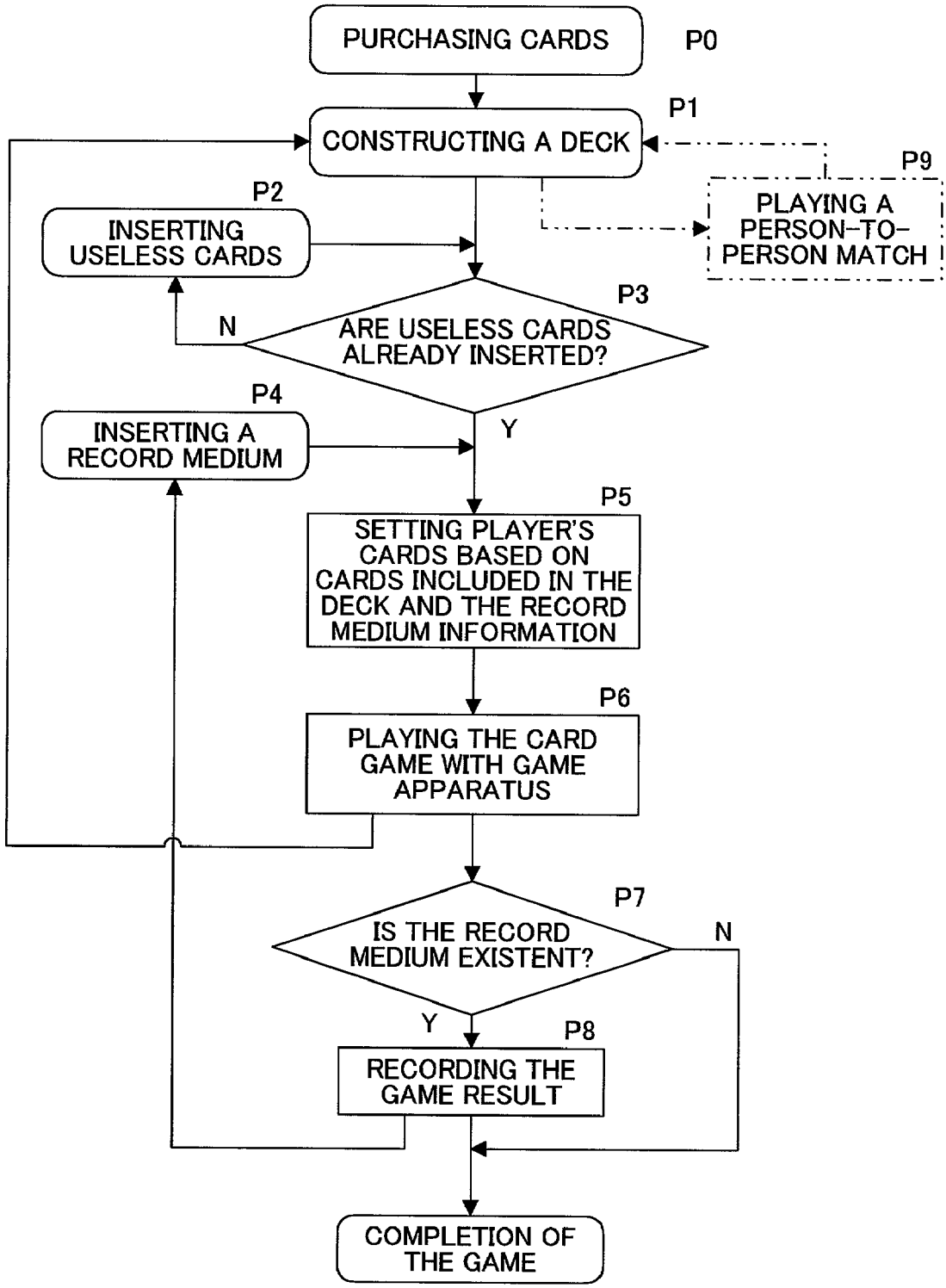
FIG. 4 shows a flowchart explaining a general flow of the card game system according to the present invention employing the card game apparatus shown in FIG. 1.

FIG. 4 shows a flowchart explaining a general flow of the card game system according to the present invention employing a card game apparatus shown in FIG. 1, as an example.

A player purchases a card (procedure P0) to construct a deck consisting of 40 to 60 cards as mentioned earlier (procedure P1). Each player having such a constructed deck can play a card game against the other player (procedure P9).

Otherwise, the player can play the card game alone using the constructed deck in the card game apparatus. Namely, using a program provided in the card game apparatus, there is also constructed a deck for a virtual opponent based on a card data previously stored in the card game apparatus to play a match against the above-mentioned player (procedure P1).

In the course that the player purchases cards to construct the deck, useless cards are increased because of a particular circumstance as mentioned earlier, as a result of purchasing cards. Accordingly, in the present invention, the card game apparatus is so structured that these useless cards can be traded for cash, coin or medal to play the game.

More specifically, the player inserts a predetermined number of useless cards into useless card insertion inlet 7 provided in card insertion unit 6 of the aforementioned card game apparatus (procedure P2). Here, as one embodiment mentioned earlier, when the card game is to be executed by injecting a coin or a medal corresponding to the charge required for executing the game instead of inserting useless cards, useless card insertion inlet 7 may be used for an injection inlet for the coin or the medal.

Thus it becomes possible to execute the card game by means of the card game apparatus (Y in procedure P3).

Further, according to the card game system of the present invention, either a card or a memory for recording (hereinafter referred to as a record medium) is adopted. This record medium stores such information that a character represented in indication area 11 or a player which has succeeded in growth with the satisfaction of predetermined conditions in the foregoing card game.

Accordingly, when executing the card game, the player's deck cards are identified based on both the information stored in the plurality of cards constructing the deck inserted in insertion inlet 8 and the information recorded in the record medium (procedure P5). In other words, using the information recorded in the record medium, the contents of indication areas 11-14 (refer to FIG. 2A) are added or modified on the individual cards in the bunch inserted in deck insertion inlet 8 as a deck.

In case that the number of cards in the deck is less than the predetermined number required for executing the game, cards are supplemented by the card data previously maintained in the memory means in the card game apparatus.

Thus both the deck for the player and the deck for the opponent virtual player to be controlled by the card game apparatus are ready to execute the card game in the card game apparatus (procedure P6).

Thereby the card game is executed, and on completion of the execution, the game result is recorded into the record medium in case the record medium is inserted, as described earlier (Y in procedure P7). Using this result record, it becomes possible to reflect the contents having been added or modified in areas 11-14 (refer to FIG. 2A) on individual cards resulting from the foregoing game results to the card game execution of the next time (procedure P8).

More specifically, additional information is given to the default information of the cards (refer to 11-14 in FIG. 2A) constructing the deck. When the card game is executed the next time, the definition including the above-mentioned additional information is regarded as is applied to the card.

Figure 5:
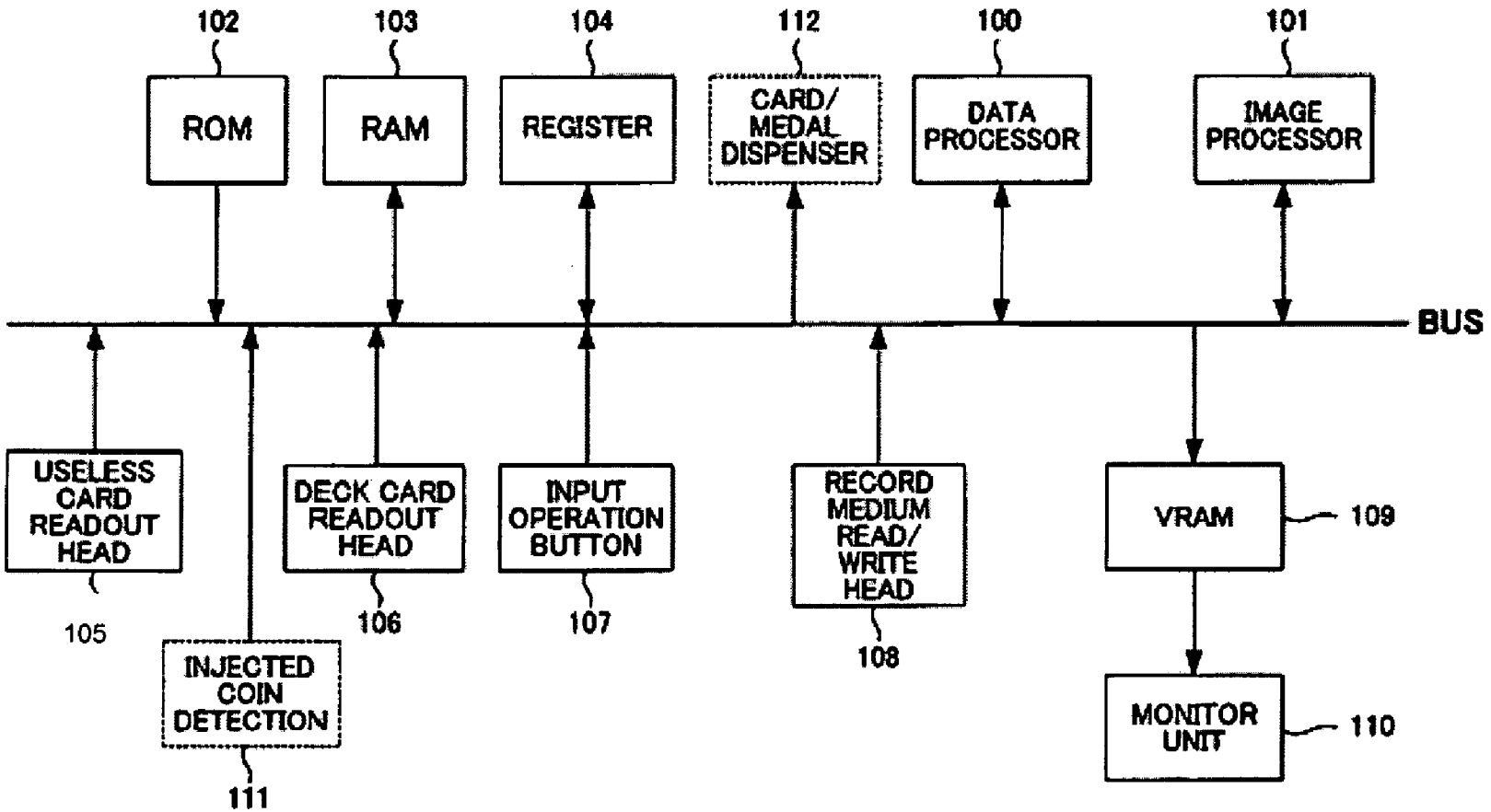
FIG. 5 shows a configuration block diagram of the card game apparatus explained in FIG. 1 to be applied for the card game system of the present invention.

FIG. 5 shows a configuration block diagram of the card game apparatus explained in FIG. 1 to be applied for the card game system of the present invention.

Corresponding to the configuration of the card game apparatus shown in FIG. 1, functional portions commonly connected to BUS are provided. Namely, there is provided input operation switch portion 107 corresponding to an input mechanism including unit movement lever 3, item decision button 4 and cancel button 5 respectively provided on operation desk 10. Input operation switch portion 107 detects an input of the above-mentioned input mechanism to forward a corresponding signal to a data processor 100 provided as a control means.

A deck card readout head 106 detects an input of the deck inserted in deck insertion inlet 8 of card insertion unit 6 to read out each barcode 15 on the plurality of card constructing the deck, to write into a RAM 103.

Useless card readout head 105 detects the number of useless cards inserted in useless card insertion inlet 7 of card insertion unit 6, to write into a register 104.

In a ROM 102, a program for controlling the execution of the card game is stored. When the card game apparatus is activated, the program stored in this ROM 102 is read out to transfer to store in RAM 103.

Further, in FIG. 5, the card game apparatus includes an image processing program 101 to perform rendering processing and texture processing against an image data, and to generate an image display data to store into a video memory 109. The image display data stored in video memory 109 is repetitively read out to forward to a monitor unit 110 (provided with a monitor screen 2 shown in FIG. 1) to display.

Additionally, referring to this figure, in the embodiment described earlier, when either a coin or a medal corresponding to the charge is injected to execute the game, instead of initiating the game using useless cards, an injected coin/medal detection function means 111 is provided instead of the useless card readout head.

Further, in case a new card or a medal is given to the player as a gift depending on the game result when the game is completed, card/medal dispensation mechanism 112 is provided on a dispensation outlet 80 provided in main body 1 for dispensing such a gift.

Figure 6:
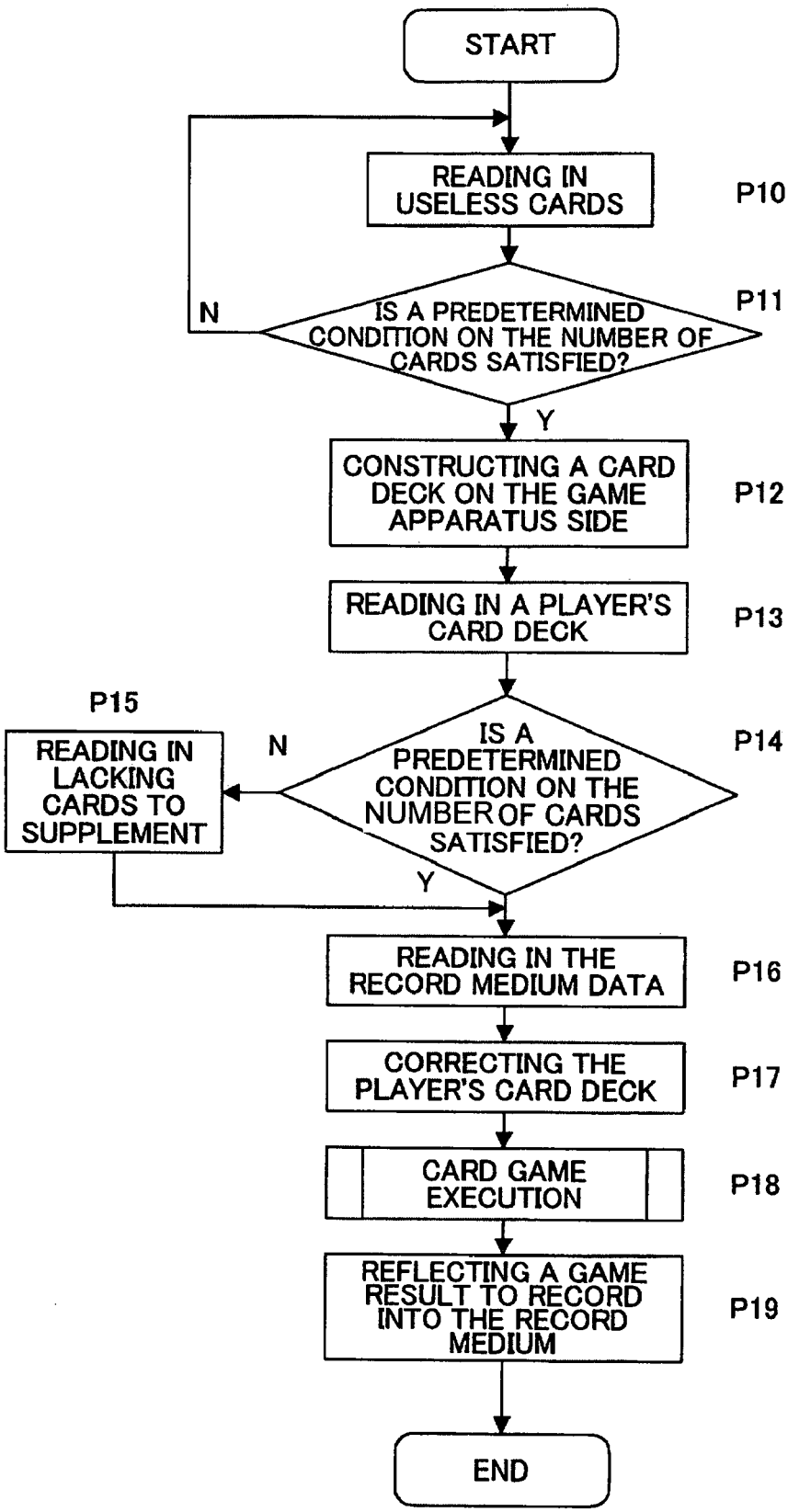
FIG. 6 shows a flowchart illustrating an example of a process flow in the card game apparatus having a configuration shown in FIG. 5.

FIG. 6 shows a flowchart illustrating an example of a process flow in the card game apparatus having a configuration shown in FIG. 5. Referring to this flowchart shown in FIG. 6, the configuration shown in FIG. 5 is explained further. In the flow shown in FIG. 6, a case that the game is initiated by useless card is illustrated.

On initiating the card game apparatus, the program stored in ROM 102 for controlling the execution of the card game is read out to transfer to store into RAM 103.

Thereafter, an operation control shown in the flow of FIG. 6 is conducted by data processor 100 in accordance with this program.

When the processing starts, useless cards is read out by useless card readout head 105 and the number of useless cards is counted and transferred to set into register 104 (procedure P10). Data processor 100 compares the number of useless cards having been transferred and set into register 104 with a predetermined value (procedure P11).

As a result of this comparison, if the number of useless cards exceeds the predetermined value, it is determined the card game is executable in the card game apparatus (Y in procedure P11).

If the card game is determined to be executable in the card game apparatus, data processor 100 reads out a card data stored in ROM 102 to construct a card deck for a virtual opponent of the game to be controlled by the card game apparatus side, to set into RAM 103 (procedure P12).

Meanwhile, deck card readout head 106 reads out barcode 15 attached to each card in the card bunch inserted in deck insertion inlet 8 to transfer to store into RAM 103 (procedure P13).

Accordingly, data processor 100 retrieves in ROM 102 using the barcode information attached to the cards in the card bunch inserted in deck insertion inlet 8 being read out and transferred into RAM 103, to write into RAM 103 the card information included in the deck inserted in deck insertion inlet 8.

At this time, data processor 100 compares the number of cards in the card bunch inserted in deck insertion inlet 8 with the number of cards necessary for playing the card game (procedure P14). If the number of cards in the card bunch is not sufficient for the predetermined number of cards for play, data processor 100 supplements card information corresponding to the short number of cards by card data being randomly read out from card data stored in ROM 102 (procedure P15).

In such a way, using both the card information included in the player's deck inserted in deck insertion inlet 8 and the card information supplemented for the short number of cards, the contents of the deck for use in the player's card game are settled to set into RAM 103.

At this time, data processor 100 reads in the record medium inserted in record medium insertion inlet 9 of the card game apparatus (procedure P16). In the record medium, there are stored contents which have been modified and added into the card during the previous execution. Therefore, the corresponding card information stored in RAM 103 which is included in the player's card deck inserted in the aforementioned deck insertion inlet 8 is modified and added to supplement (procedure P17).

Thus, both the card deck for use in the player's card game and the card deck for the virtual opponent to be controlled by the card game apparatus are determined. The information of the plurality of cards constructing each deck is stored in RAM 103.

The card game is executed using this information (procedure P18). When executing the card game, the player proceeds to play the game by placing cards to the table and determining an item against the card displayed onto screen 2 of monitor unit 110 using input mechanisms such as unit movement lever 3, item decision button 4 and cancel button 5.

On completion of the game, modification/addition information on the cards in the player's deck is recorded into the record medium in accordance with the game result (procedure P19).

Further, the player takes back the deck from deck insertion inlet 8, while the useless cards having been inserted in useless card insertion inlet 7 are taken into the card game apparatus.

A further usage of the aforementioned record medium is that, when a card to be included in the deck constructed by the player is either damaged or lost, it is possible to control so as to use a card of the same type as the damaged or lost.

Here, considering the operation system of the card game, there may be a case that a new card is continuously sold, or either the interpretation of the data included in a card or the rule is partially modified so as to adjust the balance of the game. Therefore, it is necessary to update the card data of the cards already issued according to modification mentioned above.

As one method for attaining this purpose, card data for update is recorded in the record medium to be inserted into the aforementioned record medium insertion inlet 9, to update the card data to be transferred from RAM 103 to store into ROM 102 after the record medium is inserted in record medium insertion inlet 9. Accordingly, it becomes possible for the player to execute the card game based on the up-to-date card data.

As another method for updating card data, it may be possible to update the data through a network. Considering this, there is shown in FIG. 7 a system diagram in case the card game systems according to the present invention are disposed in game facilities being connected with a network, as one application example of the present invention.

Figure 7:
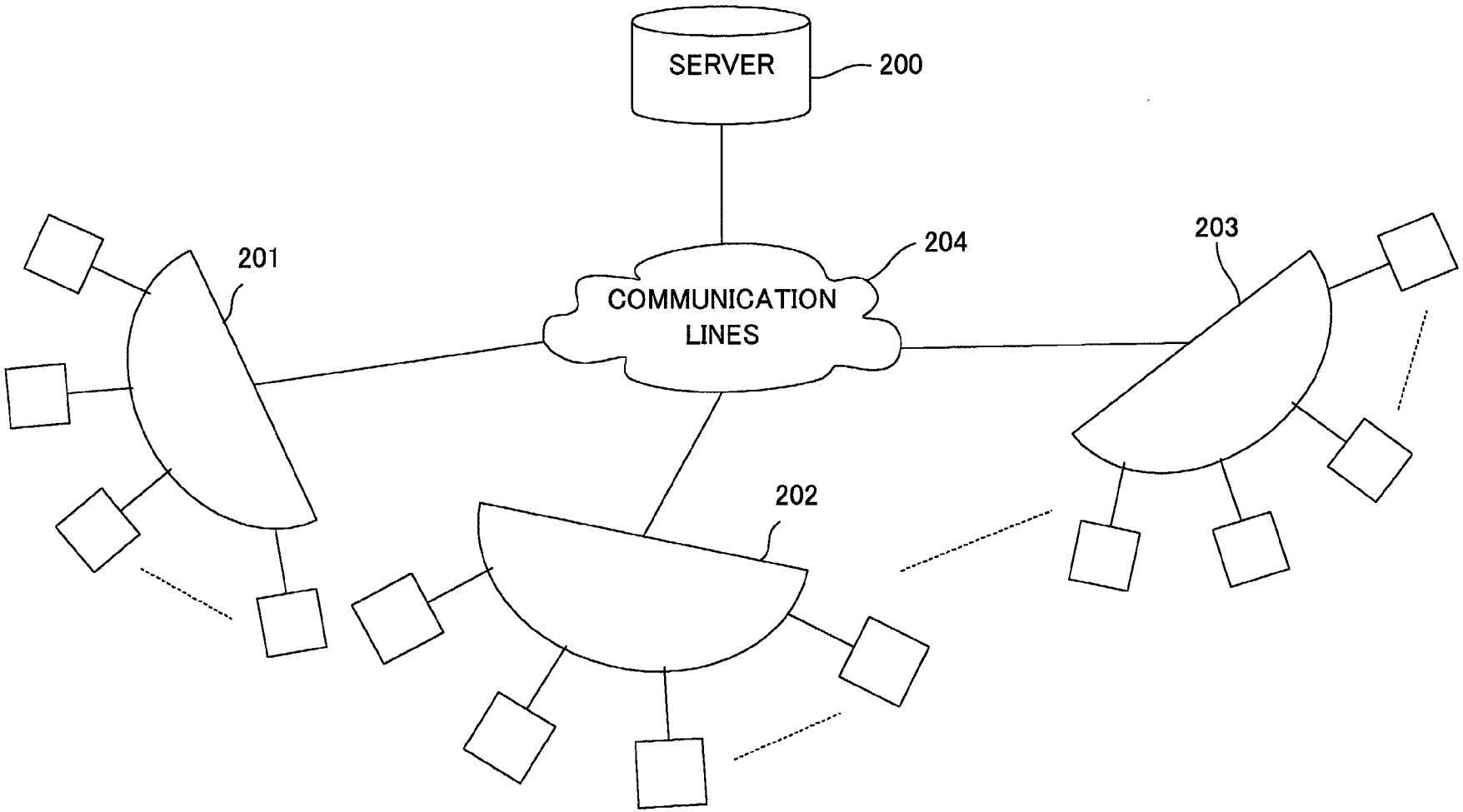
FIG. 7 shows a system diagram in case the card game systems according to the present invention are disposed in game facilities being connected with a network, as one application example of the present invention.

In FIG. 7, a plurality of game facilities 201-203 are connected to a data server 200 through communication lines 204. In each plurality of game facilities 201-203, a plurality of game apparatus are connected through LAN transmission lines.

As one of the plurality of game apparatus, the card game system according to the present invention is included. The aforementioned communication line 204 can be configured by a wired line such as cable TV line, Internet line, public telephone line, or wireless line such as satellite broadcasting line.

Card data newly issued or update data for the cards already issued are forwarded from data server 200 to each of the game facilities 201-203 through communication line 204. The forwarded data are stored in RAM 103 (refer to FIG. 5) of the card game system in the corresponding game facility.

Accordingly, the player can execute the card game in the state that the card data of the card game has been updated by transferring from ROM 102 to store.

Additionally, in the system configuration shown in FIG. 7, the connection configuration is exemplarily illustrated that data server 200 is connected to communication line 204. However, it is also possible to configure within one facility.

As the embodiments of the present invention have been explained, in a card game system according to the present invention, useless cards are traded for game charge of the card game. Therefore, it becomes possible to collect cards which remain in unnecessary condition in the market. This enables to increase total value of the cards as collection items.

Further, it is possible to execute a card game using both a deck constructed by a virtual opponent created in and operated by the card game apparatus and a deck constructed by a player. Accordingly, the player can enjoy playing the card game whenever the player wants to play without need of looking for a game opponent.

What is claimed is:

1. A card game system in which a card game is playable by using a plurality of trading cards each having card data attached thereto comprising:

a first card reception unit receiving a deck in which a plurality of trading cards is bunched for use in the play of the game;

a second card reception unit receiving at least one trading card which is not used as a card in the play of the card game at the current time, but could be received by the first card reception unit to be used in a play of a card game at a different time;

a memory for storing card data and a program for controlling a card game; and a control unit for obtaining card data attached to each of the trading cards received in the first card reception unit, executing the card game by using the obtained card data according to the program stored in the memory, and making the card game playable by a player if the at least one trading card received in the second card reception unit is enough to substitute for medals or money coins by which the card game is playable.

2. The card game system according to claim 1 wherein said card data attached to each of said plurality of trading cards is recorded in a form of a barcode on a side end of said trading card.

3. The card game system according to claim 1 wherein in case that said trading cards received in the first card reception unit are lacking for a predetermined number necessary for making said card game playable, card data is supplemented in among a plurality of trading cards stored in said memory.

4. The card game system according to claim 1 further comprising a record medium read/write device for accepting a record medium, wherein on completion of the card game execution controlled by said control unit, card game result information corresponding to trading cards received in the first card reception unit is written into said record medium.

5. The card game system according to claim 4, wherein based on said card game result written in said record medium by said record medium read/write device, said control unit updates card data being set in the trading cards received in the first card reception unit when controlling the execution of said card game.

6. The card game system according to claim 4, wherein an update data for said card data is stored into said record medium and on accepting said record medium having said update data stored by said record medium read/write device, said card data is updated by said control unit.

7. The card game system according to claim 1 further comprising a mechanism for ejecting a new card, coin or medal depending on a card game result.

8. The card game system according to claim 1 wherein said card data to be stored in said memory is updated based on update data supplied through a network.

9. The card game system according to claim 1, wherein the control unit keeps the trading cards received in the first card reception unit in the card game system after the card game is ended by the player.

10. A method for controlling to execute a card game in a card game apparatus by using a plurality of trading cards each having card data attached thereto comprising the steps of:

receiving a deck in which a plurality of trading cards is bunched for use in the play of the card game, in a first card reception unit;

receiving at least one trading card in a second card reception slot, which is not used as a card in the play of the card game at the current time, but could be received by the first card reception unit to be used in a play of a card game at a different time;

obtaining card data attached to each of the trading cards received in the first card reception unit; and making the card game playable by using the obtained card data according to a program if the at least one trading card received in the second card reception slot is enough to substitute for medals or money coins by which the card game is playable.

11. The method according to claim 10, wherein said card data attached to each of said plurality of trading cards is recorded in a form of a barcode on a side end of said trading card.

12. The method according to claim 10 further comprising the steps of:

constructing a player's deck by using card data of the trading cards received in the first card reception unit; and constructing a virtual opponent's deck by using card data of a plurality of cards stored in said memory for playing a match against a game player using the player's deck.

13. The method according to claim 12, wherein said step of constructing said player's deck further comprises the step of:

supplementing data from said plurality of card data stored in said memory when said trading cards received in the first card reception unit are lacking for a predetermined number necessary for making said card game playable.

* * * * *